US006938979B2

(12) United States Patent
Sum et al.

(10) Patent No.: US 6,938,979 B2
(45) Date of Patent: Sep. 6, 2005

(54) METHOD FOR SELECTING A SERVICING ROUTINE FOR SERVICING OF AN INKJET PRINT HEAD USING DATE-TIME-STAMP TECHNIQUE

(75) Inventors: Yuh-Wah Sum, Vancouver, WA (US); Thomas John Purwins, Camas, WA (US); Tanya Vesta Burmeister, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 961 days.

(21) Appl. No.: 09/770,418

(22) Filed: Jan. 26, 2001

(65) Prior Publication Data

US 2002/0140961 A1 Oct. 3, 2002

(51) Int. Cl.[7] ..... B41J 2/165
(52) U.S. Cl. ..... 347/23; 347/24
(58) Field of Search ..... 347/23–36

(56) References Cited

U.S. PATENT DOCUMENTS 5,610,635 A * 3/1997 Murray et al. ..... 347/7
6,049,562 A * 4/2000 Dekker ..... 375/202
6,338,540 B1 * 1/2002 Hasegawa et al. ..... 347/23

* cited by examiner

*Primary Examiner*—Stephen Meier
*Assistant Examiner*—Ly T. Tran

(57) ABSTRACT

A method for selecting a servicing routine for servicing of an inkjet print head of an inkjet printer comprises the steps of receiving a first print job with a first time information representing time information about the first print job, storing the first time information and switching off the printer, after the first time information has been stored. Later on the method according to the present invention proceeds with the steps of switching on the printer again, receiving a second print job with a second time information representing the time information of the second print job, storing the second time information, determining the time difference between the first time information and the second time information and selecting a desired print head servicing routine depending on the time difference.

12 Claims, 2 Drawing Sheets

METHOD FOR SELECTING A SERVICING ROUTINE FOR SERVICING OF AN INKJET PRINT HEAD USING DATE-TIME-STAMP TECHNIQUE

BACKGROUND OF THE INVENTION

The invention relates to a method for selecting a servicing routine for servicing for an inkjet print head and more particularly to the field of selecting a servicing routine for servicing of an inkjet print head in a manner that reduces the amount of time which is necessary for servicing.

Inkjet printers are widely used in many private and occupational computer applications. In particular, color inkjet printers are of great importance. Since e.g. digital photographing is becoming more and more popular, there is an increasing demand for a cheap color printer which provides a high picture quality.

An inkjet printer has the disadvantage that its print head can easily dry out if the printer is not used for a period of time. The drying out occurs because parts of the liquid ink stored in the print heads evaporate. This evaporation causes the performance of the print head pens to be reduced. The process of drying out first causes a reduced print quality. A further drying out can also lead to a complete failure of the inkjet printout. In that case the print head pens might irreversible be damaged so that a complete replacement of the print head might be necessary.

Therefore Hewlett Packard™ has introduced a method to prevent or at least to slow down the evaporation of the ink stored in the print head. One effective way to reduce the ink evaporation is to cap the print head pens during the period in which the ink jet printer is not active.

However capping of the print head pens and the necessary removing of the capping prior to executing a print job reduces the quality of the first printout after the capping of the print head pens has been removed. To improve this printout quality servicing routines for cleaning the print head pens after removing the capping and prior to executing a print job have been introduced. These servicing routines are called Out Of Cap servicing routines.

Table 1 shows the Out Of Cap servicing routines which are currently employed in a Hewlett Packard inkjet printer. Depending on the time the ink jet printer has been sitting idle before executing a print job and depending on the status of the power cycle of the ink jet printer, servicing routines Out Of Cap A, Out Of Cap B, Out Of Cap C, Out Of Cap D, Out Of Cap E and Out Of Cap F are initiated.

TABLE 1

Overview over currently employed servicing routines, trigger events for the servicing routines and approximate time duration for performing the servicing routines.

| servicing routine | trigger event | approximate time duration |
|---|---|---|
| OutOfCapA | Prior to executing a print job and after the printer was sitting idle for <60 min | 0.3 sec |
| OutOfCapB | Prior to executing a print job and after the printer was sitting idle for >60 min and <2 days | 0.3 sec |
| OutOfCapC | Prior to executing a print job and after the printer was sitting idle for >2 days and <7 days | 3.1 sec |
| OutOfCapD | Prior to executing a print job and after the printer was sitting idle for >7 days and <14 days | 3.1 sec |
| OutOfCapE | Prior to executing a print job and after the printer was sitting idle for >14 days OR after the printer has gone through a Clean Power Cycle | 8.7 sec |
| OutOfCapF | Prior to executing a print job after the printer has gone through a Dirty Power Cycle | 15.8 sec |

In the following the actions which are carried out when the currently employed servicing routines are executed are briefly described. The servicing routines OutOfCapA and OutOfCapB involve only a "spitting" in order to clear the nozzles. In this context "spitting" means that some drops of ink are ejected from the nozzles. The servicing routines OutOfCapC and OutOfCapD include at first a spitting of ink drops, second a dry wiping of the print head and third again a spitting of ink drops. Dry wiping means that the print head is wiped without using a solvent. By contrast the servicing routine OutOfCapE includes a wet wiping of the print head after the first spitting of ink drops and prior to the second spitting of ink drops. Wet wiping means that the print head is wiped using a solvent. The servicing routine OutOfCapF combines both the OutOfCapD and the OutOfCapE servicing, i.e. the following sequence of actions is carried out: spitting of ink drops, dry wiping the print head, again spitting of ink drops, wet wiping the print head and a last spitting of ink drops. The amount of ejected ink is different for the different servicing routines, i.e. the execution of a particular servicing causes a predefined number of ink drops to be ejected from the nozzles.

The actions which are carried out in the different OutOfCap servicing routines are briefly summarized in Table 2.

TABLE 2

Summary of the actions which are carried out when the different servicing routines are executed.

| servicing routine | actions |
|---|---|
| OutOfCapA | spitting only to clear the nozzles |
| OutOfCapB | spitting only to clear the nozzles |
| OutOfCapC | spitting, dry wiping, spitting |
| OutOfCapD | spitting, dry wiping, spitting |
| OutOfCapE | spitting, wet wiping, spitting |
| OutOfCapF | spitting, dry wiping, spitting, wet wiping, spitting |
| action | comment on action |
| dry wiping | wiping the print head without solvent |
| wet wiping | solvent assisted wiping |
| spitting | spitting for the different routines varies in the number of drops of ink ejected from the nozzles |

The status of the power cycle of the inkjet printer is classified by two different notations. In this context "clean power cycle" means that the printer had been switched off during a state in which the inkjet printer had been at rest, i.e. during switching off the printer the printer had not executed a print job and the print head had been at rest, and later on the printer was switched on. By contrast "dirty power cycle" means that before switching on the printer the inkjet printer had been switched off during a state in which the printer and in particular the print head had not been at rest.

Each Out Of Cap servicing routine requires a certain amount of time for performing the cleaning procedure. The corresponding time durations are also listed in the right column of table 1.

While the quality of the first inkjet printer printout after removing the capping of the print head pens can effectively be increased due to the usage of print head servicing routines, the speed of executing the print jobs which require a afore print head servicing is reduced.

In particular after the printer has been switched on after a clean power cycle there is no way to determine how long the print head pens have been capped. Therefore it is not possible to choose the proper servicing routine. In that case the most aggressive servicing routine Out Of Cap E is initiated in order to ensure a high printout quality (compare table 1).

In the following we will only attend the case that the printer has gone through a clean power cycle. As one can easily see from table 1 the currently employed procedure of initiating Out Of Cap servicing routines has the drawback that in most cases the time of executing a printout is delayed for a period which is longer than necessary. Only when the printer has been sitting idle for a period longer than 14 days the currently employed procedure of initiating Out Of Cap servicing routines initiates by chance the proper servicing routine and no time is wasted before executing a print job. If the ink jet printer has been sitting idle for a period shorter than 14 days the first printout is delayed because time is wasted for performing unnecessarily accurate servicing routines which last longer than the requisite servicing routine for performing sufficient cleaning of the print head pens (compare third column in table 1).

One object of the present invention is to provide a method for reducing the amount of time which is necessary for performing inkjet print head servicing routines prior to executing a print job after the inkjet printer has gone through a clean power cycle.

SUMMARY OF THE INVENTION

In order to achieve the above described object the present invention provides a method for selecting a servicing routine for servicing of an inkjet print head of an inkjet printer comprising the steps of receiving a first print job with a first time and date information representing time and date information about the first print job, storing the first time and date information and switching off the printer, after the first time and date information has been stored. Later on the method according to the present invention proceeds with the steps of switching on the printer again, receiving a second print job with a second time and date information representing the time and date information of the second print job, storing the second time and date information, determining the time difference between the first time and date information and the second time and date information and selecting a print head servicing routine depending on the time and date difference.

The present invention further provides an inkjet printer comprising a receiving unit, which receives data representing a current print job, a time determination unit connected to the receiving unit, which determines the time information of the current print job, a first memory unit, which is capable of storing a time information, and a time difference determination unit connected to both the time determination unit and the first memory unit, which time difference determination unit determines the time difference between the stored time information and the time information of the current print job. The inkjet printer further comprises a second memory unit capable of storing data representing a plurality of different print head servicing routines, a selecting unit connected to both the time difference determination unit and the second memory unit, which selecting unit selects a particular servicing routine depending on the time difference between the stored time information and the time information of the current print job, a control unit connected to the selecting unit, which control unit initiates the selected particular servicing routine, and a servicing means connected to the control unit, which servicing means is capable of performing a selected print head servicing routine, wherein the first memory unit of the inkjet printer keeps the stored time information independent of the power supply of the printer even if the printer is switched off.

According to another aspect the present invention discloses a computer program element which makes a computer execute the procedure described above.

According to a further aspect the present invention discloses a computer readable medium having a program recorded thereon, where the program makes the computer execute the procedure described above.

The above and other objects, features and advantages of the present invention will become apparent from the following description and the appended claims, taken in conjunction with the accompanying drawing.

DETAILED DESCRIPTION OF THE INVENTION

Figure 1:
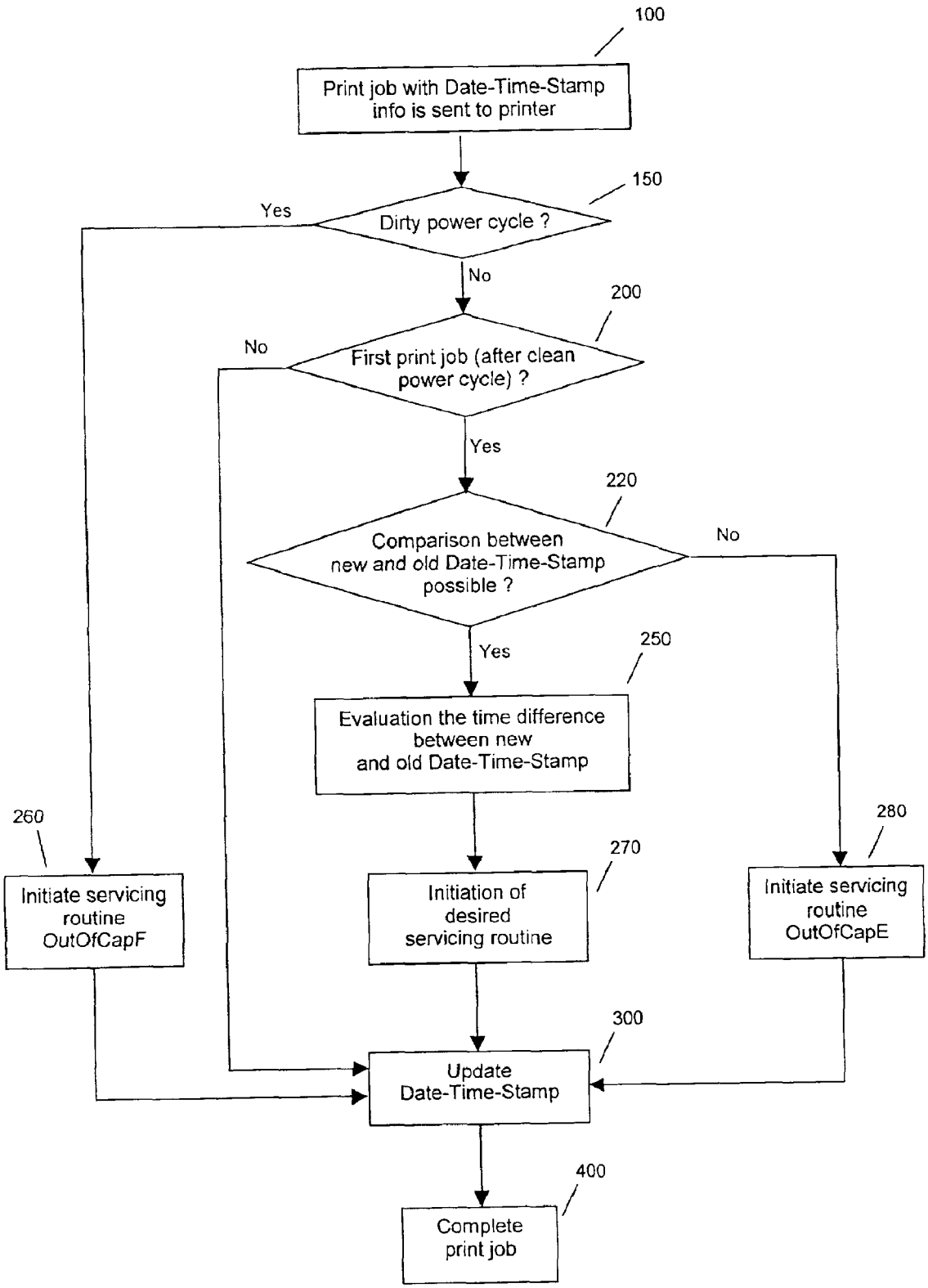
FIG. 1 shows a flow chart of a method for selecting a servicing routine for servicing of an inkjet print head according to a preferred embodiment of the present invention.

In the following a preferred embodiment of the present invention is described with reference to FIG. 1. FIG. 1 shows a flow chart illustrating the sequence of steps representing a method for selecting a servicing routine for servicing of an inkjet print head of an inkjet printer according to a preferred embodiment of the present invention.

Starting point for the method for selecting a servicing routine for servicing of an inkjet print head is a step 100 representing the data of a current print job being sent to the inkjet printer using the printer driver installed in a computer. The data representing the current print job contain a date and time information of the current print job. Such a time information could represent for instance the date and time when the current print job has been created or the date and time when the current print job has been sent to the printer. In the following this time information will also be abbreviated as Date-Time-Stamp.

After the print job with Date-Time-Stamp information has been sent to the inkjet printer (step 100) the method for selecting a servicing routine for an inkjet print head reaches a dirty power cycle test step 150. Within this step 150 it is determined whether the printer had gone through a dirty power cycle. As described above "dirty power" cycle means that before switching on the printer the inkjet printer had been switched off during a state in which the printer had not been at rest. In case the ink jet printer had gone through a dirty power cycle, the method proceeds to a step 260.

Within step 260 the servicing routine Out Of Cap F is initiated. The Out Of Cap F servicing routine is a servicing routine which is known from the state of the art. Table 3 shows the set of currently available servicing routines together with the corresponding approximate time durations for performing these servicing routines.

TABLE 3

Set of currently available servicing routines and the corresponding approximate time durations for performing these servicing routines.

| servicing routine | OutOfCapA | OutOfCapB | OutOfCapC | OutOfCapD | OutOfCapE | OutOfCapF |
|---|---|---|---|---|---|---|
| approximate time duration | 0.3 sec | 0.3 sec | 3.1 sec | 3.1 sec | 8.7 sec | 15.8 sec |

As one can gather from table 3 the Out Of Cap F servicing routine requires approximately 15.8 sec for servicing and is therefore the most long lasting servicing routine under all employed servicing routines. According to the preferred embodiment of the present invention Out Of Cap F is only initiated after the inkjet printer had gone through a dirty power cycle. After having finished step 260 the method directly proceeds to a step 300. The operation during the step 300 and the subsequent action will be explained later on.

In case the ink jet printer had not gone through a through a dirty power cycle, the method for selecting a servicing routine for an inkjet print head proceeds to a power cycle test step 200, in which the further status of the power cycle is determined. Within this test step 200 it is determined whether the current print job is the first print job after the printer has gone through a clean power cycle. As described above clean power cycle means that the printer had been switched off during a state in which the inkjet printer had been at rest, i.e. during switching off the printer had not executed a print job and the print head had been at rest and later on the printer was switched on. In case the current print job is not the first one after the inkjet printer had gone through a clean power cycle, i.e. that the current print job is at least the second print job after the printer was switched on, the method for selecting a servicing routine for servicing of an inkjet print head directly proceeds to the step 300. The operation during the step 300 and the subsequent action will be explained later on.

In case the current print job is the first one after the inkjet printer has gone through a clean power cycle, i.e. the current print job is the first print job after the printer was switched on and before switching on the printer the inkjet printer had been switched off during a state in which the printer had been at rest, the method selecting a servicing routine for an inkjet print head proceeds to a step 220. Within step 220 it is tested whether a comparison between the Date-Time-Stamp of the current print job and a time information, which is stored in a memory and which represents the time of the previously executed print job or the time of a previously executed servicing routine for the print heads is possible. Such a comparison is impossible for instance if the memory for any reason does not contain a valid time information.

According to the present invention the memory is included in or connected to the inkjet printer. The memory keeps the Date-Time-Stamp time information independent of the power supply of the printer.

In the following paragraph we will assume that the above mentioned comparison between the Date-Time-Stamp of the current print job and a time information which is stored in the memory is not possible for any reason. In this case the method continues with step 280. Under these circumstances the only available information about the maintenance accessory of the inkjet print heads is the fact that the printer had gone through a clean power cycle. For that reason the strongest servicing routine Out Of Cap F which is necessary only for dirty power cycles is for sure not necessary. Since there is no way to further determine the proper servicing routine for cleaning the inkjet print heads within step 280 the method according to a preferred embodiment of the present invention initiates the print head servicing routine Out Of Cap E, which makes sure that a sufficient cleaning of the inkjet print heads will be performed. The Out Of Cap E servicing routine lasts approximately 8.7 sec and Out Of Cap E servicing is usually initiated only when both the printer had gone through a clean power cycle and the printer has been sitting idle for a time duration longer than 14 days (compare table 1). After having finished step 260 the method directly proceeds to a step 300. The operation during the step 300 and the subsequent action will be explained later on.

In the following we will assume that the above mentioned comparison between the Date-Time-Stamp of the current print job and a time information, which is stored in the memory and which represents the Date-Time-Stamp of the previously executed print job or the time information of a previously executed servicing routine for the print heads is possible. In that case the method proceeds with a step 250. Within the step 250 a program is executed which evaluates the time difference between the Date-Time-Stamp representing the previously executed print job or the time information of a previously executed servicing routine for the print head and the Date-Time-Stamp of the current print job.

At this point it should be emphasized that the operations which are performed within the two steps 220 and 250 can be unified within one single step only. In that case the step 220 is omitted and step 250 is performed directly after step 200. If for any reason the evaluation of the time difference, which is usually performed in step 250, does not lead to a meaningful result, the method for selecting a servicing routine for servicing of an inkjet print head proceeds with the step 280. The operation of step 280 has been described above in detail.

After the step 250 or after performing the step which unifies the operations which are usually performed in step 220 and step 250 the method proceeds with a step 270. Depending on the maintaining status of the inkjet print heads which is represented by the afore evaluated time difference within this step 270 the proper servicing routine is initiated. At this point the following servicing routines for cleaning the inkjet print heads are possible: Out Of Cap A, Out Of Cap B, Out Of Cap C, Out Of Cap D and Out Of Cap E.

According to the present invention it is now possible to initiate the proper servicing routine even if the ink jet printer has just been switched on. In particular the service routines Out Of Cap A, Out Of Cap B, Out Of Cap C and Out Of Cap D can now be initiated if the printer has been sitting idle for the corresponding time.

After having finished step 270 the method proceeds with a step 300. As described above (compare also FIG. 1) the different branches of the method according to the present invention unify again in the step 300.

According to the right branch of the flow chart shown in FIG. 1 (comparison between the time information of the current print job and the time information, which is stored in a memory and which represents the time of the previously executed print job or the time of a previously executed servicing routine was not possible) the step 300 follows on the step 280. In step 280 the servicing routine Out Of Cap E was initiated.

According to the first left branch relative to the main branch of the flow chart shown in FIG. 1 (current print job is not the first one after the printer had gone through a clean power cycle) the step 300 follows on the test step 200. No servicing routine was initiated.

According to the very left branch of the flow chart shown in FIG. 1 (printer had gone through a dirty power cycle) the step 300 follows on the step 260. In step 260 the servicing routine Out Of Cap F was initiated.

The operation which is performed within the step 300 is the following: The time information representing the previously executed print job or the previously executed servicing routine for the print heads, which is stored in a memory, is updated by the new time information representing the time information of the current print job or the time of performing the desired servicing routine. The memory storing the time information can be included in or can be connected to the inkjet printer. The memory is a static random access memory (SRAM). Moreover the memory is able to keep its stored time information independent of the power supply of the printer. This can be achieved e.g. with a battery connected to the memory. In case of using a battery the user has to replace the same from time to time in order to ensure a continuous operation of the method for selecting a servicing routine for an inkjet print head. More preferably the independence of the power supply of the inkjet printer is achieved by the use of an accumulator which is charged via the supply voltage of the inkjet printer when the printer is switched on.

After updating the memory with the new time information in step 300 the method according to the present invention proceeds with a step 400. In step 400 the current print job is executed and the method for selecting a servicing routine for servicing of an inkjet print head is completed.

To sum up all the servicing routines, the corresponding trigger events according to the present invention and the approximately time durations for these routines are listed in table 4.

TABLE 4

Overview over servicing routines, trigger events for the servicing routines and approximate time duration for performing the servicing routines according to the present invention.

| servicing routine | trigger event | approximate time duration |
|---|---|---|
| OutOfCapA | Prior to executing a print job and after the printer was sitting idle for <60 min AND after the printer has gone through a Clean Power Cycle | 0.3 sec |

TABLE 4-continued

Overview over servicing routines, trigger events for the servicing routines and approximate time duration for performing the servicing routines according to the present invention.

| servicing routine | trigger event | approximate time duration |
|---|---|---|
| OutOfCapB | Prior to executing a print job and after the printer was sitting idle for >60 min and <2 days AND after the printer has gone through a Clean Power Cycle | 0.3 sec |
| OutOfCapC | Prior to executing a print job and after the printer was sitting idle for >2 days and <7 days AND after the printer has gone through a Clean Power Cycle | 3.1 sec |
| OutOfCapD | Prior to executing a print job and after the printer was sitting idle for >7 days and <14 days AND after the printer has gone through a Clean Power Cycle | 3.1 sec |
| OutOfCapE | Prior to executing a print job and after the printer was sitting idle for >14 days AND after the printer has gone through a Clean Power Cycle | 8.7 sec |
| OutOfCapF | Prior to executing a print job after the printer has gone through a Dirty Power Cycle | 15.8 sec |

Figure 2:
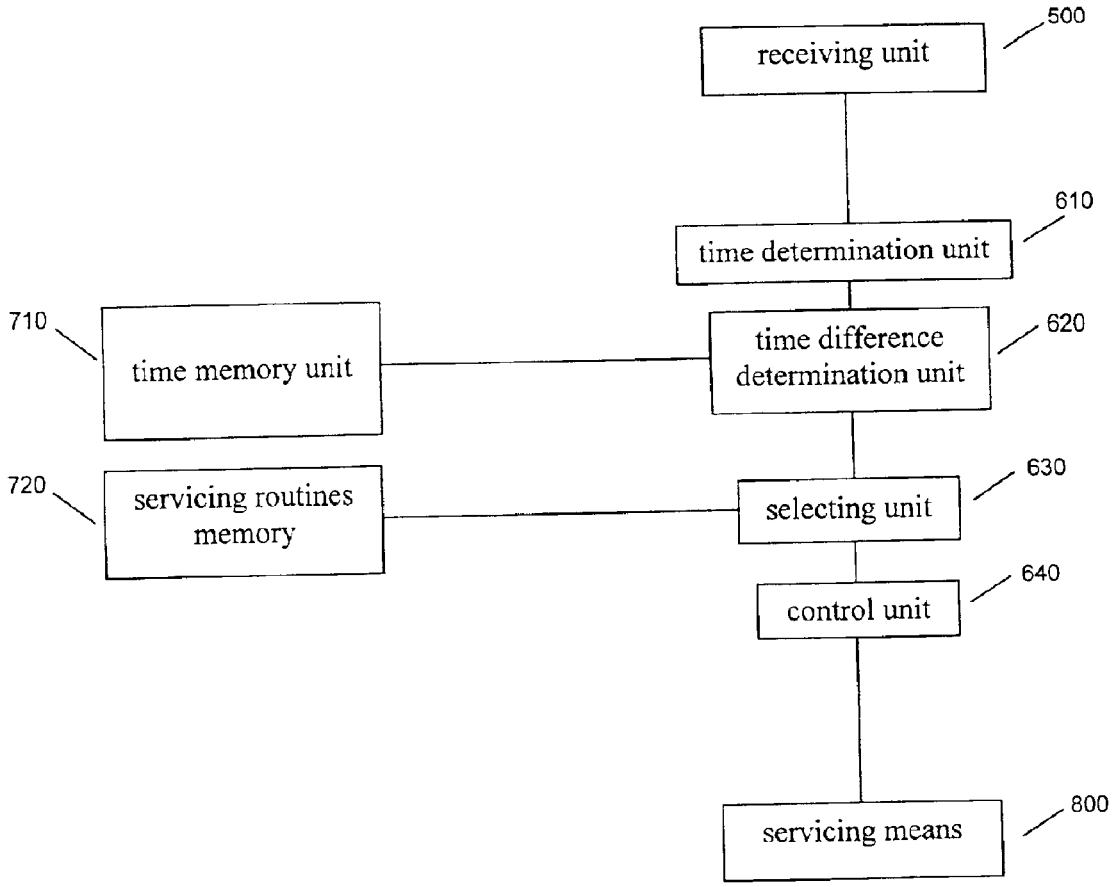
FIG. 2 shows a device included in an inkjet printer according to an embodiment of the present invention which device is capable of selecting a servicing routine for servicing of an inkjet print head.

In the following a second preferred embodiment of the present invention is described with reference to FIG. 2. FIG. 2 shows a device included in an inkjet printer which is capable of selecting a servicing routine for servicing of an inkjet print head.

The inkjet printer device includes a time determination unit 610, a time difference determination unit 620, a selecting unit 630 and a control unit 640. The inkjet printer further comprises a receiving unit 500, a time memory unit 710, a servicing routines memory 720 and a servicing means 800.

As one can see from FIG. 2 the receiving unit 500 is connected to the time determination unit 610. The time determination unit 610 is coupled to the time difference determination unit 620, the time difference determination unit 620 is coupled to the selecting unit 630 and the selecting unit 630 is coupled to the control unit 640. The servicing means 800 is connected to the control unit 640. The time memory unit 710 is connected to the time difference determination unit 620 and the servicing routines memory 720 is connected to the selecting unit 630, respectively.

The time memory unit 710 is connected to a power supply (not shown in FIG. 2) for the time memory unit 710. According to the present invention this time memory unit power supply can be provided by a battery. Therefore the time memory unit 710 can keep its time information independent of the power supply of the printer even if the printer is switched off. According to a preferred embodiment of the present invention the time memory unit 710 is connected to an accumulator which is charged via the supply voltage of the inkjet printer when the printer is switched on.

In the following the operation of the inkjet printer device for selecting a servicing routine for an inkjet printer print head according to an embodiment of the present invention is described. The receiving unit 500 receives the data of a current print job being sent to the inkjet printer. The data which represent the current print job contain a date and time information (Date-Time-Stamp) of the current print job. The receiving unit sends this Date-Time-Stamp to the time determination unit 610.

The time determination unit 610 transmits the Date-Time-Stamp information to the time difference determination unit 620. After receiving this Date-Time-Stamp information the time difference determination unit 620 fetches a further time information from the time memory unit 710. The time information, which is stored in the time memory unit 710 represents the date and the time of the last print job which has been executed. After having loaded these two time information from the time determination unit 610 and the time memory unit 710, respectively, the time difference determination unit 620 evaluates the difference between these two Date-Time-Stamps. The value of this time difference represents the amount of time which has passed since the last print job has been executed.

After having evaluated this time difference the time difference determination unit 620 updates the time memory unit 710 by transmitting the Date-Time-Stamp of the current print job to the time memory unit 710.

Meanwhile the time difference determination unit 620 transmits the evaluated time difference to the selecting unit 630. Depending on the value of the evaluated time difference the selecting unit 630 fetches certain data from the servicing routines memory 720. These fetched data correspond to the servicing routine which in accordance with the evaluated time difference has to be performed (compare table 4). The servicing routines memory 720 serves as a database which permanently stores information about the different Out Of Cap servicing routines.

After having fetched the data representing the desired servicing routine the selecting unit 630 transmits the data to a control unit 640. The control unit 640 itself uses these data in order to control the servicing means 800.

According to a further preferred embodiment of the present invention the connection between the servicing means 800 and the control unit 640 is suitable for transmitting data in two directions, i.e. from the control unit 640 to the servicing means 800 and vice versa. This ensures that in addition to selecting a servicing routine for servicing an inkjet print head the method according to the present invention is also capable of controlling of the servicing means 800. This can be done via a feedback system included in the servicing means 800 and the control unit 640, whereby the accuracy of the servicing procedure can be amended.

It is pointed out that the functions of the time determination unit 610, the time difference determination unit 620, the selecting unit 630 and the control unit 640 can all be implemented within at least one processor or within at least one specific electronic circuit. For such a unified implementation an ASIC (Application Specific Integrated Circuit) can be used. It is further emphasized that the function of the time determination unit 610, the time difference determination unit 620, the selecting unit 630 and the control unit 640 can be implemented in hardware or software or with any combination between hardware and software.

What is claimed is:

1. Method for selecting one from a plurality of different print head servicing routines for servicing an inkjet print head of an inkjet printers, comprising:

receiving a first print job with a first time information representing time information about the first print job;

storing the first time information such as the first time information is kept even when the printer is switched off;

receiving a second print job with a second time information representing the time information of the second print job;

storing the second time information;

determining the time difference between the first time information and the second time information; and selecting a print head servicing routine from the plurality of different print head servicing routines, the print head servicing routine selected being dependent upon the time difference between the first time information and the second time information.

2. Method for selecting a servicing routine for servicing of an inkjet print head of an inkjet printer according to claim 1, wherein after storing the first time information the printer is switched off; and the printer is switched on.

3. Method for selecting a servicing routine for servicing of an inkjet print head of an inkjet printer according to claim 2, wherein after updating the memory the second print job is executed.

4. Method for selecting a servicing routine for servicing of an inkjet print head of an inkjet printer according to claim 1, wherein after initiating the selected print head servicing routine the memory is updated by the second time information.

5. Method for selecting a servicing routine for servicing of an inkjet print head of an inkjet printer according to claim 1, wherein in case the determination of the time difference between the first time information and the second time information is not possible or does not lead to a reasonable result, a predefined one of the plurality of different print head servicing routines is selected.

6. Method for selecting a servicing routine for servicing of an inkjet print head of an inkjet printer according to claim 1, wherein after switching on the printer a dirty power cycle test step is carried out checking whether the printer had been switched off during a state in which the printer and in particular the print head had not been at rest.

7. Method for selecting a servicing routine for servicing of an inkjet print head of an inkjet printer according to claim 6, wherein in case before switching on the printer the inkjet printer had been switched off during a state in which the printer and in particular the print head had not been at rest, a further predefined one from the plurality of different print head servicing routines is selected.

8. Inkjet printer, comprising:

a receiving unit, which receives data representing a current print job;

a time determination unit coupled to the receiving unit, which determines the time information of the current print job;

a first memory unit, which is capable of storing a time information;

a time difference determination unit coupled to both the time determination unit and the first memory unit, which time difference determination unit determines the time difference between the stored time information and the time information of the current print job;

a second memory unit capable of storing data representing a plurality of different print head servicing routines;

a selecting unit coupled to both the time difference determination unit and the second memory unit, which selecting unit selects a particular print head servicing routine from a plurality of different print head servicing routines, wherein the print head servicing routine selected is dependent upon the time difference between the stored time information and the time information of the current print job;

a control unit coupled to the selecting unit, which control unit initiates the selected servicing routine; and a servicing means coupled to the control unit, which servicing means is capable of performing the selected print head servicing routine, wherein the first memory unit keeps the stored time information independent of the power supply of the printer even if the printer is switched off.

9. Inkjet printer according to claim 8, wherein the first memory is connected to a battery or to an accumulator.

10. Inkjet printer according to claim 9, wherein the accumulator is charged via the supply voltage of the inkjet printer when the printer is switched on.

11. Computer program element which makes a computer execute a procedure comprising the following steps for selecting a servicing routine for servicing of an inkjet print head of an inkjet printer:

receiving a first print job with a first time information representing time information about the first print job;

storing the first time information;

switching off the printer, after the first time information has been stored;

switching on the printer again;

receiving a second print job with a second time information representing the time information of the second print job;

storing the second time information;

determining the time difference between the first time information and the second time information; and selecting a print head servicing routine from a plurality of different print head servicing routines, the print head servicing routine selected being dependent upon the time difference between the first time information and the second time information.

12. Computer readable medium having a program recorded thereon, where the program makes the computer execute a procedure comprising the following steps for selecting a servicing routine for servicing of an inkjet print head of an inkjet printer:

receiving a first print job with a first time information representing time information about the first print job;

storing the first time information;

switching off the printer, after the first time information has been stored;

switching on the printer again;

receiving a second print job with a second time information representing the time information of the second print job;

storing the second time information;

determining the time difference between the first time information and the second time information; and selecting a print head servicing routine from a plurality of different print head servicing routines, the print head servicing routine selected being dependent upon the time difference between the first time information and the second time information.

* * * * *